US007729628B2

(12) United States Patent
Nakayama

(10) Patent No.: US 7,729,628 B2
(45) Date of Patent: Jun. 1, 2010

(54) IMAGE HEATING APPARATUS INCLUDING A TRANSITION TEMPERATURE LOWER THAN A TARGET LOW TEMPERATURE

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 947 days.

(21) Appl. No.: 11/449,633

(22) Filed: Jun. 9, 2006

(65) Prior Publication Data

US 2007/0059009 A1 Mar. 15, 2007

(30) Foreign Application Priority Data

Sep. 13, 2005 (JP) ..... 2005-266008

(51) Int. Cl.
*G03G 15/20* (2006.01)

(52) U.S. Cl. ..... 399/69

(58) Field of Classification Search ..... 399/69
See application file for complete search history.

(56) References Cited

U.S. PATENT DOCUMENTS 5,550,621 A 8/1996 Ogawahara
6,064,850 A * 5/2000 Matsuo et al. ..... 399/333
2003/0202814 A1 10/2003 Senda et al.
2004/0042810 A1 3/2004 Cho
2005/0220506 A1 10/2005 Nakayama ..... 399/323
2005/0286919 A1 * 12/2005 Matsumoto ..... 399/69
2006/0133836 A1 6/2006 Nakayama ..... 399/68
2006/0245798 A1 11/2006 Nakayama ..... 399/329

FOREIGN PATENT DOCUMENTS

CN 1475875 2/2004
JP 7-36308 2/1995
JP 7-72759 3/1995

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

An image heating apparatus includes a heating rotatable member for heating, in a nip, an image on a recording material; a heater for heating the image heating member; a cooling device for cooling the image heating member, wherein when a target temperature of the image heating member is changed to a low temperature which is lower than the target temperature, the apparatus is operable in a mode wherein a temperature of the image heating member is lowered by the cooling device to a transition temperature which is lower than the low temperature, and then, the temperature of the image heating member is raised by the heater to the low temperature.

6 Claims, 9 Drawing Sheets

IMAGE HEATING APPARATUS INCLUDING A TRANSITION TEMPERATURE LOWER THAN A TARGET LOW TEMPERATURE

FIELD OF THE INVENTION AND RELATED ART

The present invention relates to an image heating apparatus for heating an image on recording medium. Such an image heating apparatus is employed by a copying machine, a printing machine, a facsimile machine, etc., for example.

A fixing apparatus having an image heating apparatus has been commonly employed in the field of an electrophotographic image forming apparatus. An example of a fixing apparatus such as the one described above is a fixing apparatus which employs a pair of rollers, more specifically, a heating roller and a pressure applying roller. In recent years, in order to improve an image forming apparatus in terms of the glossiness of a color print it yields, or to deal with such recording medium that is thicker than ordinary recording medium or is different in material from ordinary recording medium, image forming apparatuses, the fixing apparatus of which has two or more target temperature settings (fixation temperatures), have been devised.

For example, the fixing apparatus disclosed in Japanese Laid-open Patent Application 7-36308 is provided with two target temperature settings so that when in the black-and-white mode, the fixing apparatus is rendered lower, in the glossiness level at which an image is outputted, than when in the full-color mode, in order to achieve both the object of producing a satisfactory low gloss copy such as a copy used in an office and the object of producing a full-color copy which is satisfactory in terms of color mixture and glossiness. In the case of this apparatus, the downtime, that is, the period in which the apparatus cannot be used for image formation, which occurs when the target temperature of the fixing apparatus is lowered as the image formation mode is switched, is substantial for the following reason. That is, in the case of the structural arrangement employed by this apparatus, it is only the spontaneous heat radiation that is used for reducing the temperature of the fixation roller to the lower target temperature.

The downtime such as the one described above can be reduced by improving the fixing apparatus in response by reducing the fixing apparatus (fixation roller) in thermal capacity. However, from the standpoint of increasing the fixing apparatus in fixation speed while maintaining the fixing performance of the fixing apparatus at a satisfactory level, there is a limit to the reduction of the thermal capacity of the fixing apparatus.

Thus, in the case of the fixing apparatus disclosed in Japanese Laid-open Patent Application 7-42759, the fixing apparatus is forcefully cooled by a cooling fan in order to reduce the downtime which occurs when the fixing apparatus is switched in target temperature for image fixation.

However, it is difficult to uniformly cool the entirety of the fixation apparatus, in terms of the width direction of the fixing apparatus, simply by employing a proper cooling fan and devising a proper duct structure.

Further, in terms of the width direction of a fixing apparatus, the end portions of a fixing apparatus are greater in spontaneous heat radiation than the center portion thereof. Therefore, if a fixing apparatus is simply cooled by a cooling fan or the like, the temperature of the end portions of the fixing apparatus tend to become too low.

In other words, if a fixing apparatus is simply cooled by a cooling fan or the like after the target temperature for image fixation is lowered, the fixing apparatus becomes very nonuniform in temperature distribution in terms of its width direction after the target temperature of the fixing apparatus is switched to the lower level. This sometimes reduced the fixing apparatus in fixation performance. More specifically, after the switching, an image which is nonuniform in glossiness was sometimes yielded.

SUMMARY OF THE INVENTION

The primary object of the present invention is to provide an image heating apparatus which is substantially shorter than an image heating apparatus in accordance with the prior art, in terms of the length of time it takes for an image heating member to become ready for an image heating operation after the image heating member is switched in target temperature from the high target temperature to the low target temperature.

Another object of the present invention is to provide an image heating apparatus which is substantially shorter than an image heating apparatus in accordance with the prior art, in terms of the length of time it takes for the temperature of its image heating member fall to the new target temperature after the target temperature for the fixation roller is reduced, and which does not suffer from the problem that its image heating member becomes nonuniform in temperature distribution as the target temperature of the image heating member is reduced.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to some of the embodiments of the present invention. These embodiments of the present invention are the preferred embodiments of the present invention. However, they are not intended to limit the scope of the present invention.

First, referring to FIG. 1, the image forming apparatus in the preferred embodiments of the present invention will be described.

(Image Forming Apparatus)

Figure 1:
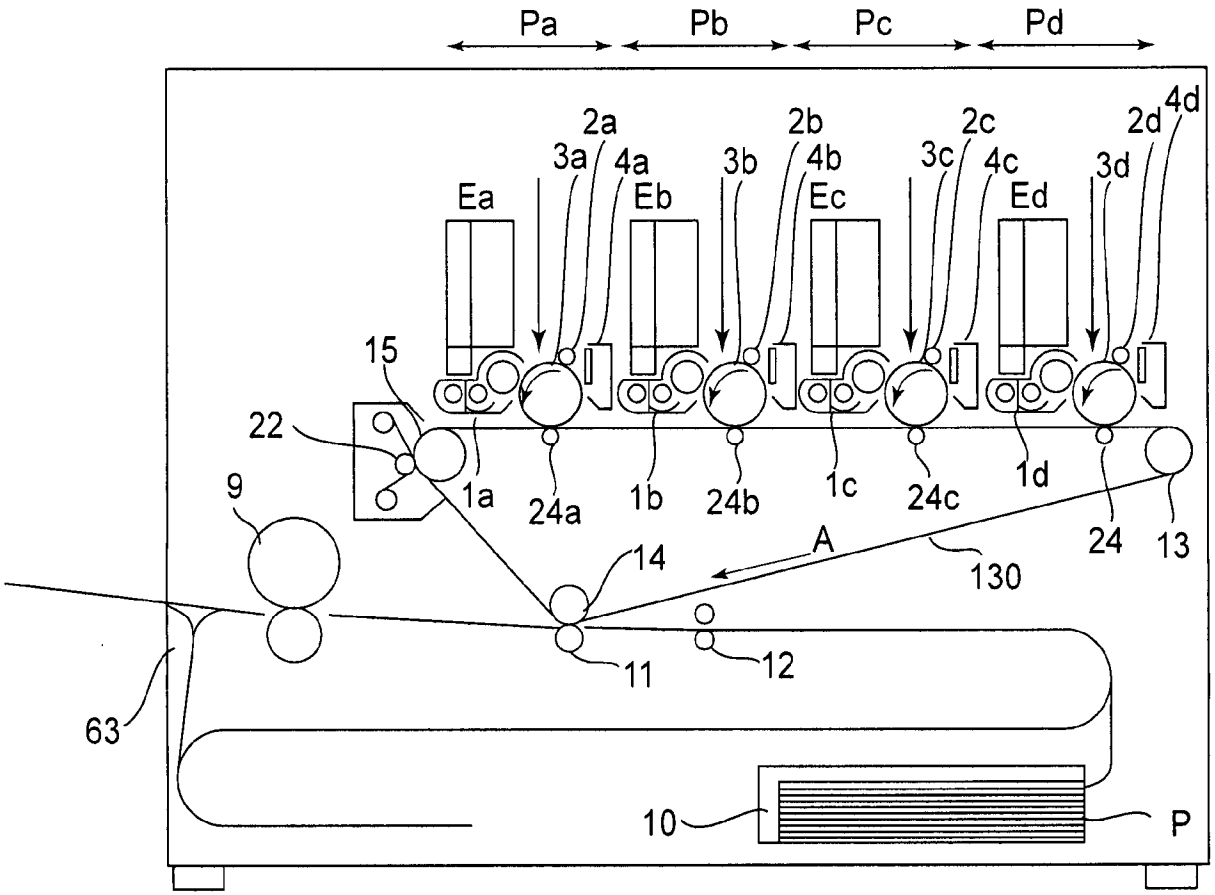
FIG. 1 is a sectional view of the image forming apparatus in the preferred embodiments of the embodiment of the present invention.

Within the apparatus shown in FIG. 1, first to fourth image forming portions Pa, Pb, Pc, Pd are disposed in parallel to form four monochromatic toner images different in color through the process of forming a latent image, process of developing the latent image, and process of the developed latent image.

The image forming portions Pa, Pb, Pc, and Pd are provided with their own image bearing members, which in this embodiment are electrophotographic photosensitive drums 3*a*, 3*b*, 3*c*, and 3*d*, respectively, on which monochromatic toner images different in color are formed, one for one. The image forming apparatus is provided with an intermediary transferring member 130, which is disposed next to the photosensitive drums 3*a*, 3*b*, 3*c*, and 3*d*. The toner images formed on the photosensitive drums 3*a*, 3*b*, 3*c*, and 3*d*, one for one, are transferred (primary transfer) onto the intermediary transferring member 130, and then, are transferred onto a sheet of recording medium P in the secondary transferring portion. After the transfer of the toner images onto the recording medium P, the recording medium P is subjected to heat and pressure in a fixing portion 9 to fix the toner images. Then, the recording medium P is discharged as a permanent copy from the image forming apparatus.

Adjacent to the peripheral surfaces of the photosensitive drums 3*a*, 3*b*, 3*c*, and 3*d*, drum charging devices 2*a*, 2*b*, 2*c*, and 2*d*, developing devices 1*a*, 1*b*, 1*c*, and 1*d*, primary transfer charging devices 24*a*, 24*b*, 24*c*, and 23*d*, and cleaners 4*a*, 4*b*, 4*c*, and 4*d* are disposed, respectively. The image forming apparatus is also provided with an unshown light source apparatus and an unshown polygon mirror, which are in the top portion of the image forming apparatus main assembly.

A beam of laser light is emitted from the light source apparatus toward the polygon mirror, which is being rotated. As a result, the beam of laser light is deflected in an oscillatory fashion. Then, this oscillatory beam of laser light is deflected by a reflection mirror, and then, is focused on the peripheral surfaces of the photosensitive drums 3*a*, 3*b*, 3*c*, and 3*d* by an f-θlens. In other words, the charged portions of the photosensitive drums 3*a*, 3*b*, 3*c*, and 3*d* are exposed. As a result, a latent image in accordance with the image formation signals is formed on each of the photosensitive drums 3*a*, 3*b*, 3*c*, and 3*d*.

The developing apparatuses 1*a*, 1*b*, 1*c*, and 1*d* contain preset amounts of yellow, magenta, cyan, and black toners, respectively, as developers, which are supplied by unshown toner supplying apparatuses. The developing devices 1*a*, 1*b*, 1*c*, and 1*d* develop the latent images on the photosensitive drums 3*a*, 3*b*, 3*c*, and 3*d*, into visible images formed of yellow, magenta, cyan, and black toners, respectively.

The intermediary transferring member 130 is rotated at the same velocity as the peripheral velocities of the photosensitive drums 3, in the direction indicated by an arrow mark.

The visible image on the photosensitive drum 3*a*, that is, the image formed of the toner of yellow color (first color), is moved through the nip between the photosensitive drum 3*a* and intermediary transferring member 130. While the image formed of the yellow toner is moved through the nip, it is transferred (intermediary transfer) onto the outward surface (in terms of loop which intermediary transferring member forms) of the intermediary transferring member 130, by the electric field formed by the transfer bias applied to the intermediary transferring member 130, and the pressure in the nip.

Similarly, the visible image formed of the toner of magenta color, or the second color, the visible image formed of the toner of cyan color, or the third color, and the visible image formed of the toner of black color, or the fourth color, are sequentially transferred in layers onto the yellow toner image on the intermediary transferring member 130. As a result, a color copy of an original is synthetically effected on the intermediary transferring member 130.

Designated by a referential symbol 11 is a secondary transfer roller, which is supported by bearings, and is parallel to the rollers suspending the intermediary transferring member 130 and in contact with the downwardly facing portion of the outward surface of the intermediary transferring member 130. To the secondary transfer roller 11, a preset secondary transfer bias is applied by a secondary transfer bias source. The color image which has just been effected on the intermediary transferring member 130 by transferring, in layers, multiple monochromatic toner images, different in color, onto the intermediary transferring member 130 is transferred onto the recording medium P in the following manner. That is, the recording medium P is fed from a sheet feeder cassette 10, is conveyed by a pair of registration rollers 12, is moved past a transferring portion entrance guide, and is delivered to the contact nip between the intermediary transferring member 130 and secondary transfer roller 11 with a preset timing. At the same time as the delivery of the recording medium P to the contact nip, the application of the secondary transfer bias from a bias application power source is started. As a result, the synthetically formed color image on the intermediary transferring member 130 is transferred by this secondary transfer bias onto the recording medium P.

After the completion of the primary transfer, the photosensitive drums 3*a*, 3*b*, 3*c*, and 3*d* are cleaned by the cleaners 4*a*, 4*b*, 4*c*, and 4*d*, respectively (toner remaining on the photosensitive drums 3 are removed by the cleaners 4), being thereby prepared for the subsequent process of forming a latent image. The toner and other debris remaining on the intermediary transferring member 130 are wiped away by placing a piece of cleaning web 19 (nonwoven fabric) in contact with the surface of the intermediary transferring member 130.

After the transfer of the color image (multiple monochromatic toner images different in color), the transfer medium P is introduced into the fixing apparatus 9. In the fixing apparatus 9, the color image is fixed to the transfer medium P by the application of heat and pressure to the transfer medium P. Then, the transfer medium P is discharged from the image forming apparatus through a sheet outlet 63.

(Fixing Apparatus)

Figure 2:
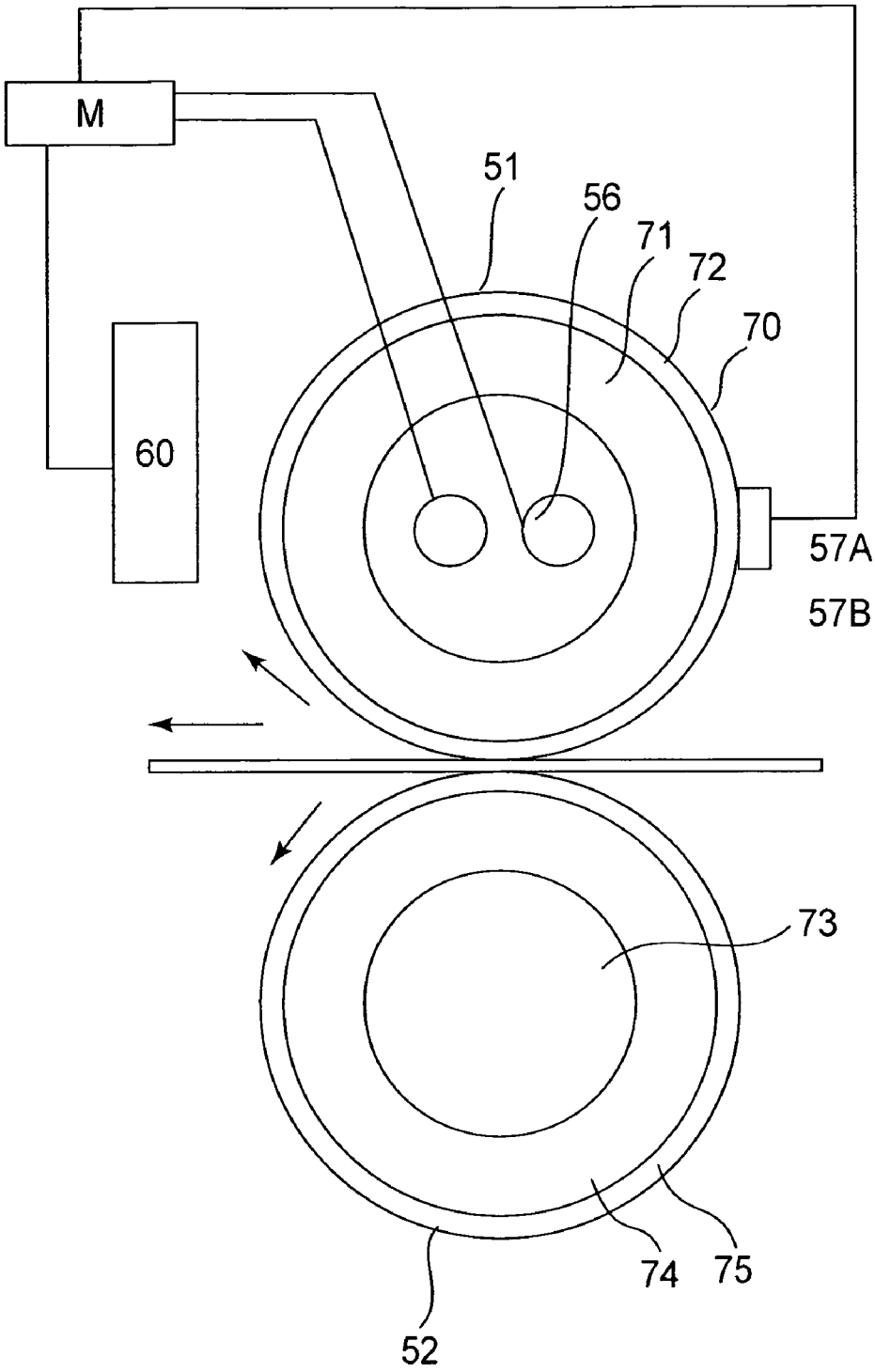
FIG. 2 is a sectional view of the fixing apparatus in the preferred embodiments of the present invention.

FIG. 2 is a sectional view of the fixing apparatus, as an example of a fixing apparatus equipped with an image heating apparatus, in this embodiment, showing the basis structure thereof. This fixing apparatus is a fixing apparatus which employs a pair of heat rollers, more specifically, a fixation roller 51 as an image heating member, and a pressure roller 52 as a nip forming member. It fixes toner to the recording medium P by applying heat and pressure to the recording medium P and the toner thereon while it conveys the recording medium P through the nip formed between the two rollers 51 and 52. The fixation roller 51 is made up of a cylindrical metallic core 71 and a release layer 70 formed on the peripheral surface of the metallic core 71. The metallic core 71 contains a fixation heater as a heating means (heat source). The pressure roller 52 (pressure applying member) is made up of: a metallic core 72, which is in the form of a piece of metallic rod; a heat resistant rubber layer 74 formed on the peripheral surface of the metallic core 72; and a release layer 75, as the surface layer, formed on the peripheral surface of the heat resistant rubber layer 74. Some fixation rollers employed by a fixing apparatus for a color image forming apparatus have a silicone rubber layer impregnated with silicone oil, or a fluorinated rubber layer, instead of release layer 70, as the surface layer. The present invention is also applicable to a fixing apparatus employing a fixation roller having the silicone rubber layer impregnated with silicone oil, or the fluorinated rubber layer, such as those of the pressure roller, described above.

Figure 3:
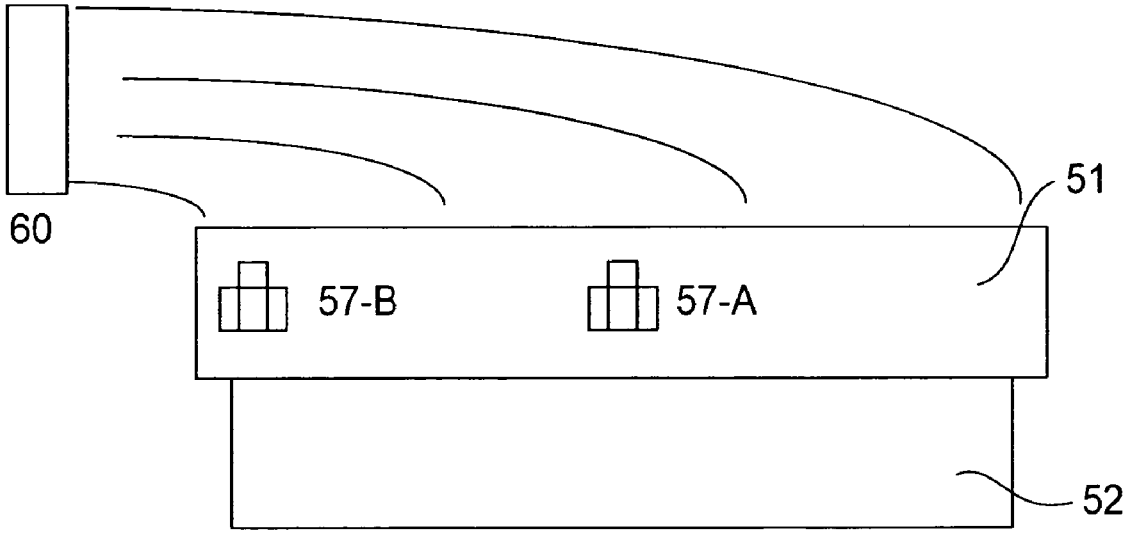
FIG. 3 is a schematic drawing showing the positioning of the main thermistor and subordinate thermistor.

The fixing apparatus is provided with a main thermistor 57-A (first temperature detection element) and a subordinate thermistor 57-B (second temperature detection element). The main thermistor 57-A is disposed in contact, or virtually in contact, with roughly the center of the fixation roller 51, in terms of the direction perpendicular to the recording paper conveyance direction. FIG. 3 is a schematic drawing showing the positions of the main thermistor 57-A and subordinate thermistor 57-B relative to the fixation roller 51 in terms of the direction perpendicular to the recording paper conveyance direction. Referring to FIG. 2, a control portion M (controller) adjusts the surface temperature of the fixation roller 51 by controlling the power supplies to the main and subordinate heaters in response to the output from the main thermistor 57-A. The subordinate thermistor 57-B is also connected to the controller M. In this embodiment, however, the subordinate thermistor 57-B is employed as a backup thermistor which is used in situations such as when recording paper has wrapped around the fixation roller 51, or when the main thermistor 57-A has a problem. In other words, normally, the subordinate thermistor 57-B is not used for controlling the power supplies to the main and subordinate heaters.

The fixation roller 51 is 60 mm in external diameter. It is made up of: a hollow metallic core which is formed of aluminum and is 55.0 mm in external diameter; a rubber layer formed on the peripheral surface of the metallic core, of silicone rubber, which is 20° in hardness (JIS-A: under 1 kg of load) and is 2.5 mm in thickness; and a layer of PFA formed on the peripheral surface of the rubber layer, of a piece of PFA tube, and is 50 μm in thickness. In the hollow of the fixation roller 51, a pair of halogen heaters as heat sources are disposed, which are controlled in temperature by the main thermistor 57-A and an unshown controller.

The pressure roller 52 is 60 mm in external diameter. It is made up of: a hollow metallic core 71 which is formed of aluminum and is 56.0 mm in external diameter; an elastic layer 72 formed on the peripheral surface of the metallic core 71, of silicone rubber, which is 16° in hardness (JIS-A: under of 1 kg of load) and is 2.0 mm in thickness; and a layer of PFA formed on the peripheral surface of the elastic layer, of a piece of PFA tube, and is 50 μm in thickness. The pressure roller 52 is kept pressed against the fixation roller 51 with the application of a total pressure of 500-1,000 N, forming thereby a contact area (nip), which is roughly 10 mm in terms of the recording paper conveyance direction. The fixing apparatus is structured so that the pressure roller 52 is rotated by the rotation of the fixation roller 51.

The fixation heater 56 as a heating means is a heat source, the power supply to which is controlled by the controller M (FIG. 2), based on the output of the main thermistor 57-A, in order to control the temperature of the fixation roller 51. In this embodiment, the fixation heater 56 is made up of two heaters: a main heater and a subordinate heater. In terms of the width direction of the fixing apparatus, that is, the lengthwise direction of the fixation roller 51, the center portion of the main heater of the fixation roller 51 is greater in the amount of heat generation (heating capacity) than the lengthwise end portions of the fixation roller 51, whereas the lengthwise end portions of the subordinate heater of the fixation roller 51 are greater in the amount of heat generation (heating capacity) than the center portion of the subordinate heater.

Figure 4:
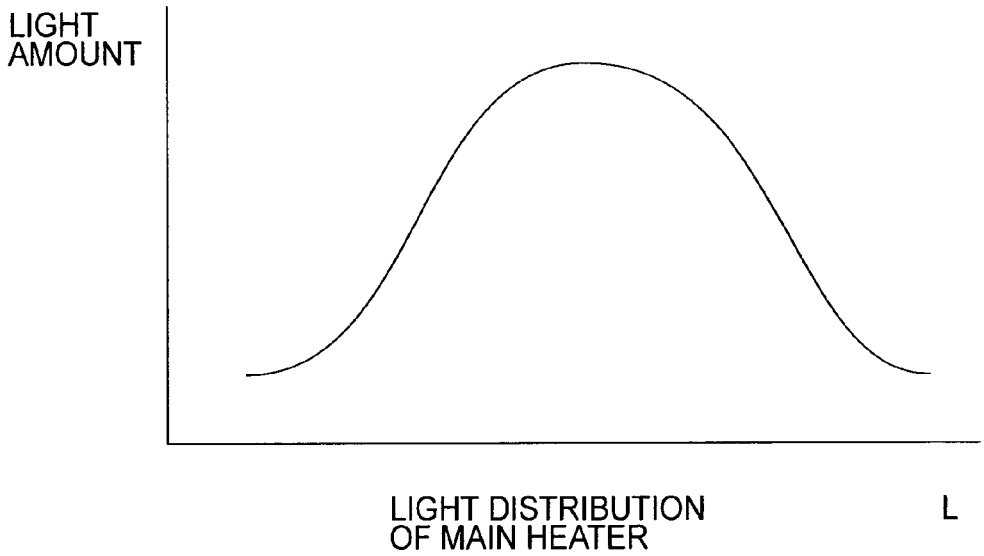
FIG. 4 is a graph showing the light distribution of the main heater.
Figure 5:
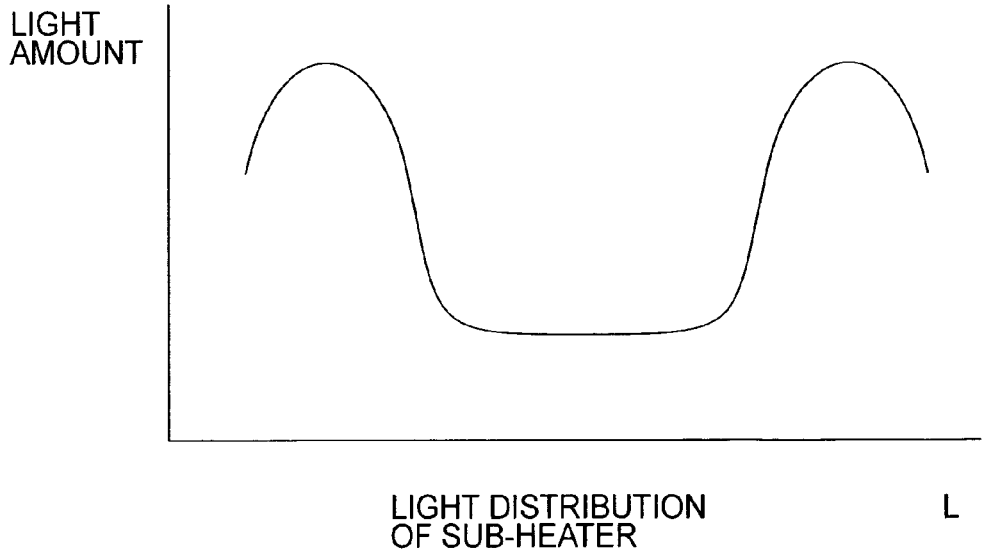
FIG. 5 is a graph showing the light distribution of the subordinate heater.

Next, referring to FIGS. 4 and 5, the light distribution of the fixation heater of the fixing apparatus in this embodiment will be described. First, referring to FIG. 4, the distribution curve of the amount of the light which the main heater 56-A emits is higher across the center portion in terms of the lengthwise direction of the fixation roller 51; it is lower across the lengthwise end portions. On the other hand, the distribution curve of the amount of the light which the subordinate heater 56-B emits is lower across the center portion, as shown FIG. 5; it is higher across the lengthwise end portions. In other words, the main heater 56-A and subordinate heater 56-B are complimentary to each other in terms of the light distribution.

As power is supplied to the main heater 56-A of the fixation heater 56 structured as described above, the center portion of the fixation roller 51 is rendered higher in temperature than the lengthwise end portions of the fixation roller 51, whereas as power is supplied to the subordinate heater, the lengthwise end portions of the fixation roller 51 is rendered higher in temperature than the center portion of the fixation roller 51. Therefore, the lengthwise center portion of the fixation roller 51 and the lengthwise end portions of the fixation roller 51 can be independently controlled in temperature by turning on or off the two heaters different in light distribution by the controller M.

When forming an image on a sheet of recording medium, the dimension of which in terms of the direction perpendicular to the recording medium conveyance direction is larger or smaller than the normal size, the ratio between the main and subordinate heaters, in terms of the length of time they are kept turned on, may be adjusted by the controller M, based on the size of the sheet of recording medium in terms of the direction perpendicular to the recording medium conveyance direction. In other words, with the employment of the above described structural arrangement, it is possible to prevent the fixation roller 51 from becoming nonuniform in temperature distribution (in terms of width direction of fixing apparatus, that is, lengthwise direction of fixation roller).

When the fixing apparatus is kept on standby, the effect of the spontaneous heat radiation on the temperature of the fixing apparatus is greater than when the fixing apparatus is actually fixing an image. Thus, when the fixing apparatus is kept on standby, the amount of the heat exchanged between the lengthwise end portions of the fixation roller 51 and the frame of the fixating apparatus is greater than the amount of the heat exchanged between the lengthwise center portion of the fixation roller 51 and the frame of the fixating apparatus frame. Further, the amount of heat exchanged between the lengthwise end portions of the fixation roller 51 and the ambient air and the frame of the fixing device is greater than the amount of heat exchanged between the lengthwise center portion of the fixation roller 51 and the ambient air or the like.

In other words, the lengthwise end portions of the fixation roller 51 are greater in the amount of heat radiation than the lengthwise center portion of the fixation roller 51. In this embodiment, therefore, when the fixing apparatus is kept on standby, or is kept in the like conditions, the subordinate heat is activated to prevent the end portions of the fixation roller 51 from becoming lower in temperature than the center portion of the fixation roller 51.

In comparison, when printing an image, heat is robbed from the lengthwise center portion of the fixation roller 51 as recording medium is conveyed in contact with the lengthwise center portion of the fixation roller 51, whereas it is only the spontaneous heat radiation that robs heat from the lengthwise end portions of the fixation roller 51. Therefore, when printing an image, the lengthwise end portions of the fixation roller 51 become higher in temperature than the center portion of the fixation roller 51. This phenomenon (which hereafter may be referred to as "out-of-path temperature increase") is particularly conspicuous when an image is formed on a sheet of recording medium, the dimension of which in terms of the lengthwise direction of the fixation roller 51 is smaller than the normal size. In this embodiment, therefore, when the fixing apparatus is in the condition such as the one described above, the main heater is activated to prevent the end portions of the fixation roller 51 from becoming higher in temperature than the center portion of the fixation roller 51. Incidentally, if necessary, both heaters may be activated when the fixing apparatus is kept on standby or when printing an image.

The cooling apparatus 60 is provided with a cooling fan for cooling the fixation roller 51. Its cooling operation is controlled (it is turned on or off) by the controller M. The cooling fan may be used to prevent the fixation roller 51 from overheating, when forming an image on a sheet of recording medium, the dimension of which in terms of the lengthwise direction of the fixation roller 51 is smaller than the normal one, or after the completion of a printing operation.

The image forming apparatus in this embodiment is a high speed apparatus. Therefore, when this image forming apparatus is used for continuously printing a substantial number of copies, the above described phenomenon that the portions of the fixation roller 51, which do not correspond to the recording medium path, becomes higher in temperature than the portion of the fixation roller 51 which corresponds to the recording medium path is more conspicuous. In this embodiment, therefore, the cooling apparatus 60 is set up so that its cooling capacity is higher across the range corresponding to the lengthwise end portions of the fixation roller 51 than the range corresponding to the lengthwise center portion of the fixation roller 51.

Next, the fixation temperature (target temperature) for the fixation roller 51 will be described.

In this embodiment, the fixation speed (peripheral velocity of fixation roller 51) is set to 200 mm/sec. Further, the fixing apparatus is designed so that when the image forming apparatus is in the full-color mode, that is, the mode for forming a full-color image, the fixation temperature is set to 190° C. When an image forming operation was carried out with the fixing apparatus kept under the above described conditions, excellent images, more specifically, images which were no less than 30 degrees in the glossiness level measured by a 60° optical system, were obtained. Further, the thus obtained images did not suffer from the problems related to color mixture and nonuniformity in glossiness. Moreover, the fixing apparatus performed very well even when the image forming apparatus was in the cardstock mode, that is, the mode for printing on thick recording medium.

On the other hand, when the fixation speed is set to above-mentioned value, the fixation temperature for the black-and-white mode, that is, the mode for forming a black-and-white image, is set to 160° C., in order to prevent the problem that if a black-and-white image is fixed at the same fixation temperature as that for the color mode, a copy which is too high in glossiness across the letter portions, being therefore inferior in terms of visual recognition, is yielded.

In this embodiment, therefore, the fixation temperature for the black-and-white mode is set to 160° C., which is substantially lower than 190° C., in order to obtain an image which is excellent in terms of visual recognition, that is, an image, the glossiness of which is no more than 20 degrees.

For the above described reasons, in this embodiment, the fixation temperature for the full-color mode and that for the cardstock mode are set to 190° C. Further, the fixation temperature for the black-and-white mode and that for the thin recording medium mode are set to 160° C.

As an image forming apparatus having a fixing apparatus structured as described above receives a command for changing the image formation mode of the apparatus, in particular, when the mode to which the image formation mode of the apparatus is switched is different in fixation temperature from the mode from which the image formation mode of the apparatus is switched, the on-going printing job is interrupted, and the operational mode of the apparatus is temporarily switched to the adjustment mode (temperature change mode), in which the apparatus cannot be used for printing. Then, as the temperature of the fixation roller 51 settles to the intended fixation temperature, the adjustment mode is cancelled to ready the apparatus for image formation.

Hereafter, the preferred embodiments of the present invention and the comparative embodiments of the present invention will be described regarding the results of the change in the fixation temperature subsequent to the change in the operational mode of the image forming apparatus.

Comparative Embodiment 1

Figure 6:
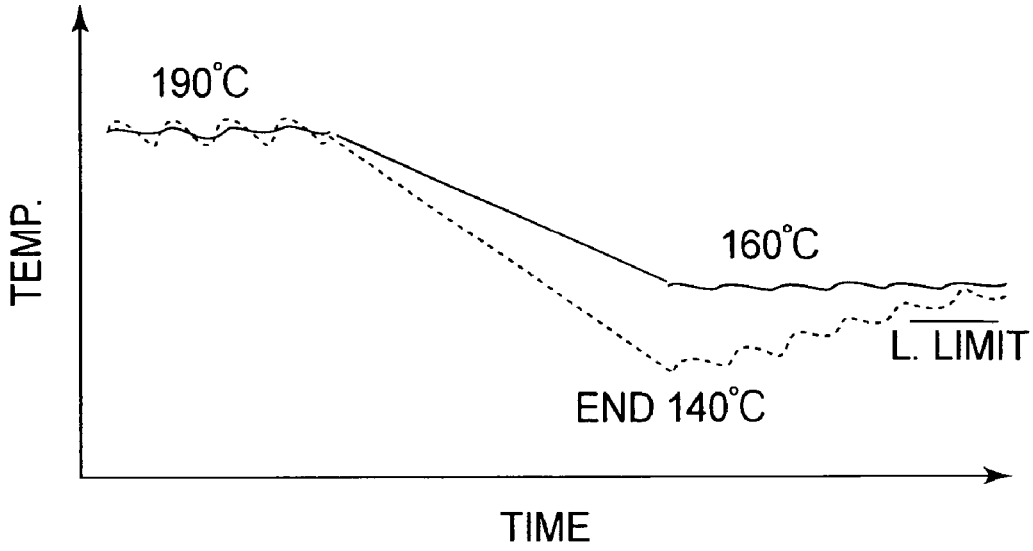
FIG. 6 is a graph showing the downward temperature change of the fixation roller in the first comparative embodiment of the present invention.

FIG. 6 is a graph showing the downward change of the fixation roller temperature, which occurred due to spontaneous heat radiation when the target temperature of the fixation roller was switched from 190° C. to 160° C. while the ambient temperature was 25° C. The solid line represents the temperature of the center portion of the fixation roller, and the broken line represents the temperature of the end portions of the fixation roller. During the initial period, in which the image forming apparatus was on standby, the temperature of the fixation roller was controlled so that the temperature of its center portion was maintained at 190° C. While the fixing apparatus was kept in this condition, the heating by the heater was stopped for roughly two minutes to allow heat to spontaneously radiate from the fixation roller. After roughly two minutes, the temperature of the center portion of the fixation roller reached 160° C., but, the temperature of the end portions of the fixation roller fell to 140° C., causing thereby fixation failure. This occurred because the rate of heat exchange between the end portions of the fixation roller and the frame of the fixing apparatus is higher than that between the center portion of the fixation roller, and the rate of heat exchange between the end portions of the fixation roller and the ambient air is higher than that between the center portion of the fixation roller and the ambient air. In other words, this occurred because the end portions of the fixation roller were higher in the amount of heat radiation than the center portion of the fixation roller. Then, the apparatus was kept in the standby mode, and while the apparatus was kept in the standby mode, the temperature of the end portions of the fixation roller recovers to a level at which a fixing operation can be satisfactorily performed. The total length of time it took for the fixing apparatus to become ready for image fixation after the changing of the fixation temperature (target temperature) for the fixing apparatus was four minutes.

Comparative Embodiment 2

Figure 7:
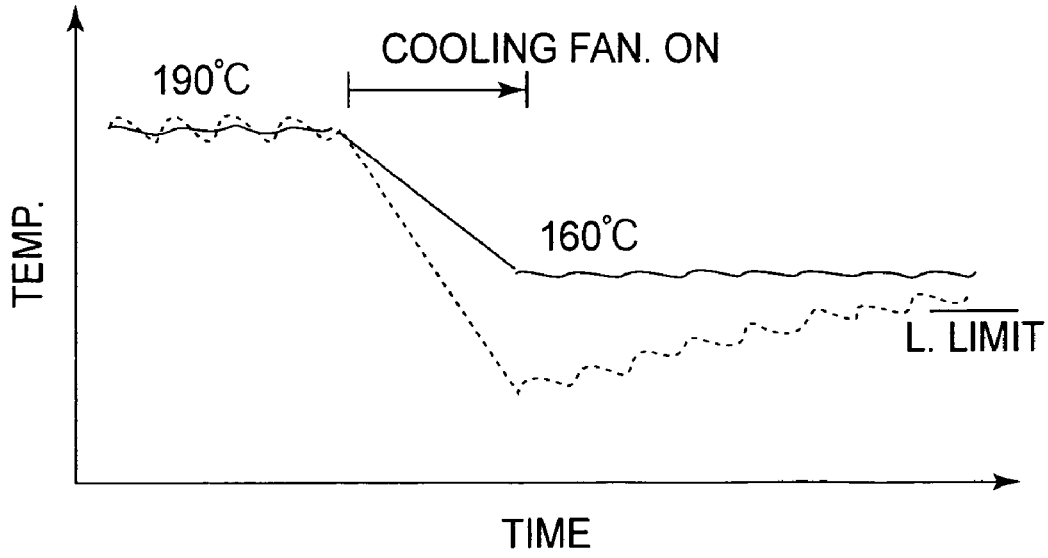
FIG. 7 is a graph showing the downward temperature change of the fixation roller of the second comparative embodiment of the present invention.

FIG. 7 is a graph showing the downward change of the fixation roller temperature, which occurred when the fixation roller was cooled with the use of a cooling fan after the target temperature of the fixation roller was switched from 190° C. to 160° C. while the ambient temperature was 25° C., as it was in the first comparative embodiment. In this case, the temperature of the center portion of the fixation roller reached the target temperature of 160° C. in roughly one minute. However, the temperature of the end portions of the fixation roller fell to 135° C., causing thereby fixation failure. When a cooling fan is used, the center portion of the fixation roller is rapidly cooled. Therefore, the temperature of the center portion of the fixation roller quickly reaches the target temperature. Also in this case, due to the difference in the amount of heat radiation between the end portions of the fixation roller and the center portion of the fixation roller, the temperature of the end portions of the fixation roller falls faster than that of the center portion of the fixation roller. Further, because of the distribution of the cooling capacity of the cooling fan in terms of the lengthwise direction of the fixation roller, the temperature of the end portions of the fixation roller tends fall more in this comparative embodiment than in the first comparative embodiment. Therefore, in this comparative embodiment, the image forming apparatus (fixing apparatus) had to be kept longer in the standby mode (fixation roller heating mode). Thus, it took additional three minutes for the temperature of the end portion of the fixation roller to recover to the target temperature. Thus, the total length of time it took for the fixing apparatus to become ready for image fixation after the changing of the target temperature for the fixing apparatus in this comparative embodiment was the same as that in the first comparative embodiment.

Thus, in the preferred embodiments of the present invention, the cooling apparatus is switched in the cooling capacity distribution (in terms of lengthwise direction of fixation roller) by the control M, based on the state of the fixing apparatus, that is, whether the fixing apparatus is being actually used for image fixation (period in which portions of fixation roller outside paper path overheats), or is being switched in fixation temperature (from higher fixation temperature to lower fixation temperature). More specifically, when changing the target temperature of the fixing apparatus, the cooling apparatus is switched in cooling capacity distribution by the controller M so that the cooling capacity of the cooling apparatus becomes lower across the ranges corresponding to the end portions of the fixation roller than the range corresponding to the center portion of the fixation roller. As for the concrete means for switching the cooling apparatus in cooling capacity distribution, the cooling apparatus is made up of multiple cooling fans, which can be individually turned on or off by the controller M, and which are aligned in the lengthwise direction of the fixation roller, so that the cooling apparatus can be changed in cooling capacity distribution by individually turning on or off the multiple cooling fans. Incidentally, for an actual fixing operation, the cooling apparatus is switched in cooling capacity distribution by the controller M so that the cooling capacity of the cooling apparatus becomes higher across the range corresponding to the end portions of the fixation roller than the ranges corresponding to the center portion of the fixation roller.

When the structural arrangement for switching a cooling apparatus in cooling capacity distribution was employed, the temperature of the end portions of the fixation roller was prevented from falling below 140° C. However, the cooling apparatus used in this second comparative embodiment used the ambient air as cooling medium. Therefore, the switching of the cooling capacity distribution of the cooling apparatus was not as effective as expected to change the heat distribution of the fixing roller. That is, as the cooling efficiency of the cooling apparatus is reduced across the range corresponding to the end portions of the fixation roller, it also reduced across the range corresponding to the center portion of the fixation roller. As a result, the second comparative embodiment was shorter by only several tens of seconds than the first comparative embodiment, in terms of the total length of time it took to complete the process of switching the target temperature of the fixing apparatus.

In the preferred embodiments of the present invention, therefore, a structural arrangement such as the following one, which will be described next, is employed to further improve the fixing apparatus in accordance with the present invention (to further reduce total length of time necessary required to complete process of switching target temperature of fixing apparatus).

Preferred Embodiment 1

Figure 8:
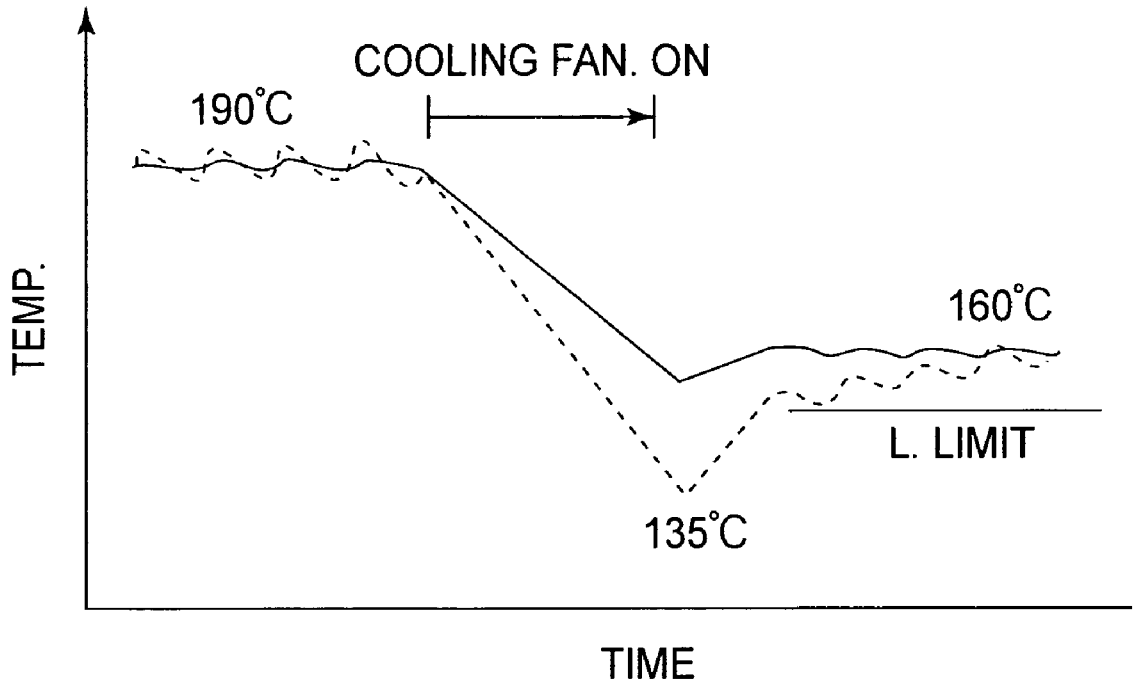
FIG. 8 is a graph showing the downward temperature change of the fixation roller of the fixing apparatus in the first preferred embodiment of the present invention.

FIG. 8 is a graph showing the temperature change of the fixation roller, which occurred when the fixing apparatus in this preferred embodiment of the present invention was switched in target temperature when the ambient temperature was 25° C. In this embodiment, the fixing apparatus is structured so that the temperature of the fixation roller can be set to a preparatory setting of 155° C., which is lower than the lower target temperature, or 160° C.

Figure 9:
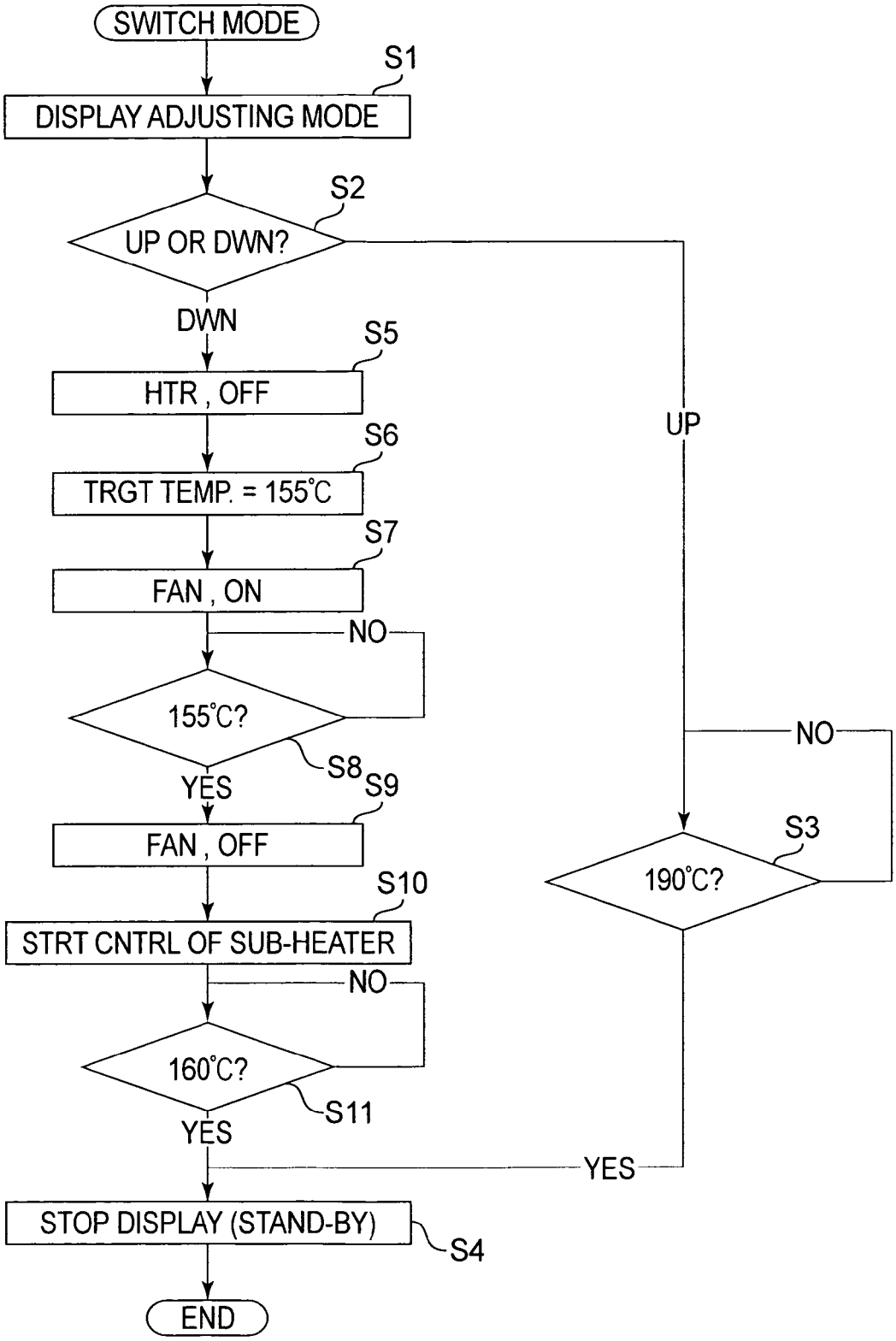
FIG. 9 is a flowchart of the temperature control of the fixation roller in the first preferred embodiment of the present invention.

FIG. 9 is a flowchart of the fixation roller temperature control sequence carried out in this preferred embodiment of the present invention.

As the operational mode is switched to the adjustment mode, it is displayed that the operational mode has just been switched to the adjustment mode (S1), in which the apparatus cannot be used for image formation.

Next, it is determined whether the target temperature is to be increased or decreased (S2).

If it is determined that the target temperature is to be increased, it is determined whether or not the temperature of the fixation roller has reached the higher target temperature, or 190° C. (S3). As the temperature of the fixation roller reaches 190° C., the apparatus is put on standby, and "adjustment mode" display is cancelled (S4), ending thereby the mode switching process. As soon as the adjustment mode ends, the apparatus is ready for image formation.

On the other hand, if it is determined that the target temperature is to be decreased, the heater is turned off (S5), and the target temperature is switched to the preparatory setting, or 155° C. (S6). Then, the cooling fans 2 are turned on (S7). Then, it is determined whether or not the temperature of the fixation roller has reached 155° C. (S8). In this preferred embodiment, as the temperature of the center portion of the fixation roller reaches 160° C. after the temperature of the fixation roller falls from 190° C., or the higher target temperature, to 155° C., or the preparatory setting, it is determined that the apparatus is ready for printing. More specifically, as the temperature of the fixation roller reaches 155° C., the cooling fans 2 are turned off (S9), and the heating of the fixation roller is started using the subordinate heater (S10). Then, it is determined whether or not the temperature of the fixation roller has reached 160° C., or the lower target temperature (S11). If it is determined that the temperature of the fixation roller has reached 160° C., step S4 is taken.

In this preferred embodiment, the length of time required to cause the temperature of the fixation roller to change from 190° C. to 155° C., or the preparatory setting, by cooling the fixation roller with the use of the cooling fans 2, was roughly one minute and 15 seconds. When the temperature of the fixation roller reached 155° C., the temperature of the end portions of the fixation roller was 135° C., which was lower than the temperature of those in the second comparative embodiment.

The length of time it took for the lengthwise center portion of the fixation roller to reach 160° C. by being heated by the subordinate heater after the cooling fans were stopped was roughly 55 seconds. When the temperature of the lengthwise center portion of the fixation roller reached the 160° C., the temperature of the lengthwise end portions of the fixation roller had recovered to roughly 160° C.; in other words, the temperature distribution of the fixation roller had become nonproblematic in terms of image fixing function. The total length of time it took for the temperature of the fixation roller to reach the satisfactory temperature level for image fixation after the target temperature of the fixation roller was switched (length of time from when operational mode is switched to when adjustment mode is cancelled) was roughly two minutes, which is substantially shorter than that required by a fixing apparatus in accordance with the prior art. In other words, this preferred embodiment of the present invention made it possible to both the object of quickly changing the temperature of the fixation roller to the lower target temperature, and the object of rendering the temperature distribution (in terms of lengthwise direction of fixation roller, or widthwise direction of fixing apparatus) of the fixation roller satisfactory for image fixation.

In this preferred embodiment, as the fixing apparatus is switched in target temperature, the temperature of the end portions of the fixation roller temporarily falls to a level lower than that in the comparative embodiments. However, this preferred embodiment is lower in the length of time it takes for the temperature of the fixation roller to recover to the new target temperature than the comparative embodiments. Therefore, it is shorter in the total length of time it takes to complete the process of changing the target temperature of the fixation roller. In both of the comparative embodiments, as soon as the temperature of the fixation roller reaches 160°, or the lower target temperature, the apparatus is put on standby, and the temperature of the fixation roller is controlled by turning on or off the subordinate heater. In these cases, the temperature of the center portion of the fixation roller also increases before the temperature of the end portions of the fixation roller recover. Therefore, as the temperature of the fixation roller reaches 160° C., or the new target temperature, the heater is turned off. Thus, the length of time the heater is kept turned on amounts to a value equivalent to 30% in terms of duty, making it difficult for the temperature of the end portions of the fixation roller to recover.

In comparison, in this preferred embodiment, the temperature of the fixation roller is allowed to temporarily fall to the preparatory setting, which is lower than 160° C., or the new target temperature for the fixation roller, before restoring the temperature of the fixation roller to the new target temperature. In other words, in this preferred embodiment, the operation for cooling the fixation roller is not stopped as soon as the temperature of the fixation roller reaches the lower target temperature; the cooling operation is continued until the temperature of the fixation roller falls to the preparatory temperature level. That is, in this preferred embodiment, a difference between the lower fixation temperature (target temperature) for a heating operation, and the preparatory temperature setting is earned as a temperature control margin. Thus, when heating the fixation roller to increase the temperature of the fixation roller from the preparatory temperature level to the lower fixation temperature, the subordinate heater is turned on or off in response to the output of the main thermistor.

The subordinate heater is structured so that its lengthwise end portions are higher in heating performance than its center portion; the center portion is enabled to generate a certain amount of heat, although not as much as the end portions. In addition, there is the temperature control margin described above. Therefore, the lengthwise center portion of the fixation roller can be made to reach the lower target temperature roughly at the same time as the lengthwise end portions of the fixation roller, without causing the problem that the temperature of the lengthwise center portion of the fixation roller is rendered excessively high by the subordinate heater. In other words, during the period in which the lengthwise center portion of the fixation roller recovers from 155° C. to 160° C., the subordinate heater is kept turned on at 100% duty, making it possible to increase the temperature of the end portions of the fixation roller faster than in the comparative embodiments.

Incidentally, regarding the first and second comparative embodiments, it is possible to turn the subordinate heater regardless of the temperature of the center portion of the fixation roller, in order to increase only the temperature of the end portions of the fixation roller, after the temperature of the center portion of the fixation roller fell to the target temperature. This method, however, requires that the fixing apparatus is structured so that the operation of the subordinate heater can be controlled (subordinate heater can be turned on or off) regardless of the output of the main thermistor. With the provision of such a structural arrangement, it is possible that the changes in the ambient conditions, the changes in voltage, the manufacturing errors regarding the power supply to the heaters, etc., will cause the temperature of the apparatus to abnormally rise. For these reasons, it is unwise to employ a structural arrangement such as this one.

Based on the viewpoint given above, the structural arrangement in the first preferred embodiment was employed, which made it possible to substantially reduce the length of time it takes for the temperature distribution of the fixation roller to become satisfactory for the image fixation, compared to the set-ups in the comparative embodiments.

As described above, the structural arrangement in this preferred embodiment makes it possible to prevent an image heating member from becoming nonuniform in temperature distribution (in terms of its lengthwise direction), while reducing the downtime (period in which image formation is impossible) which occurs when changing the target temperature of the fixing apparatus.

Embodiment 2

Figure 10:
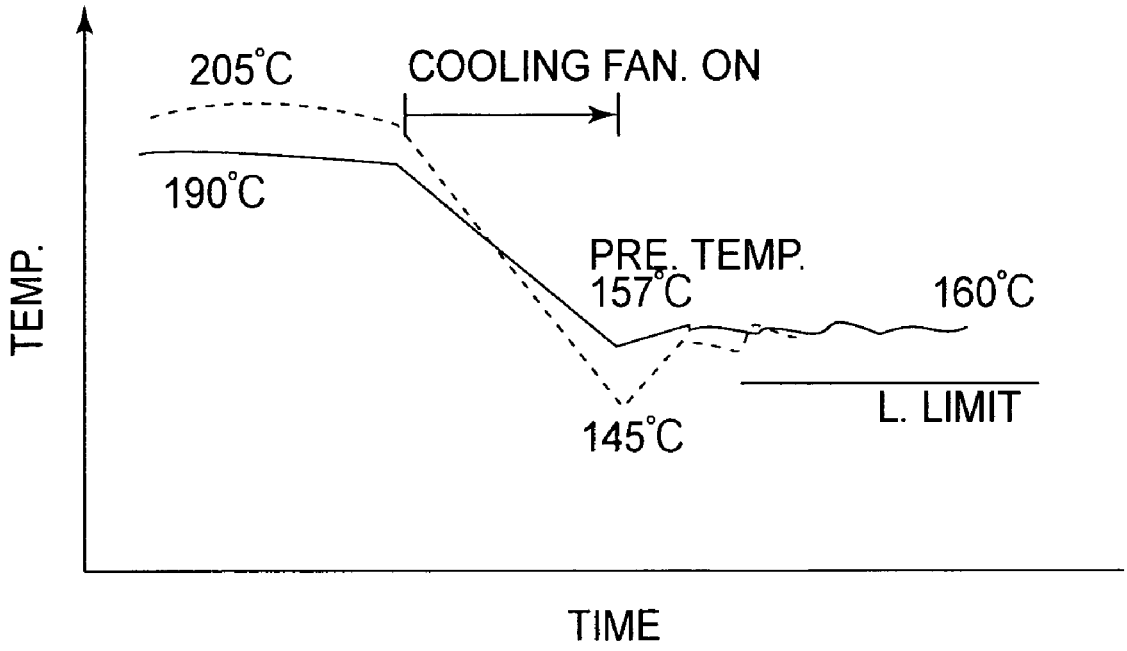
FIG. 10 is a graph showing the downward temperature change of the fixation roller in the second preferred embodiment of the present invention.
Figure 11:
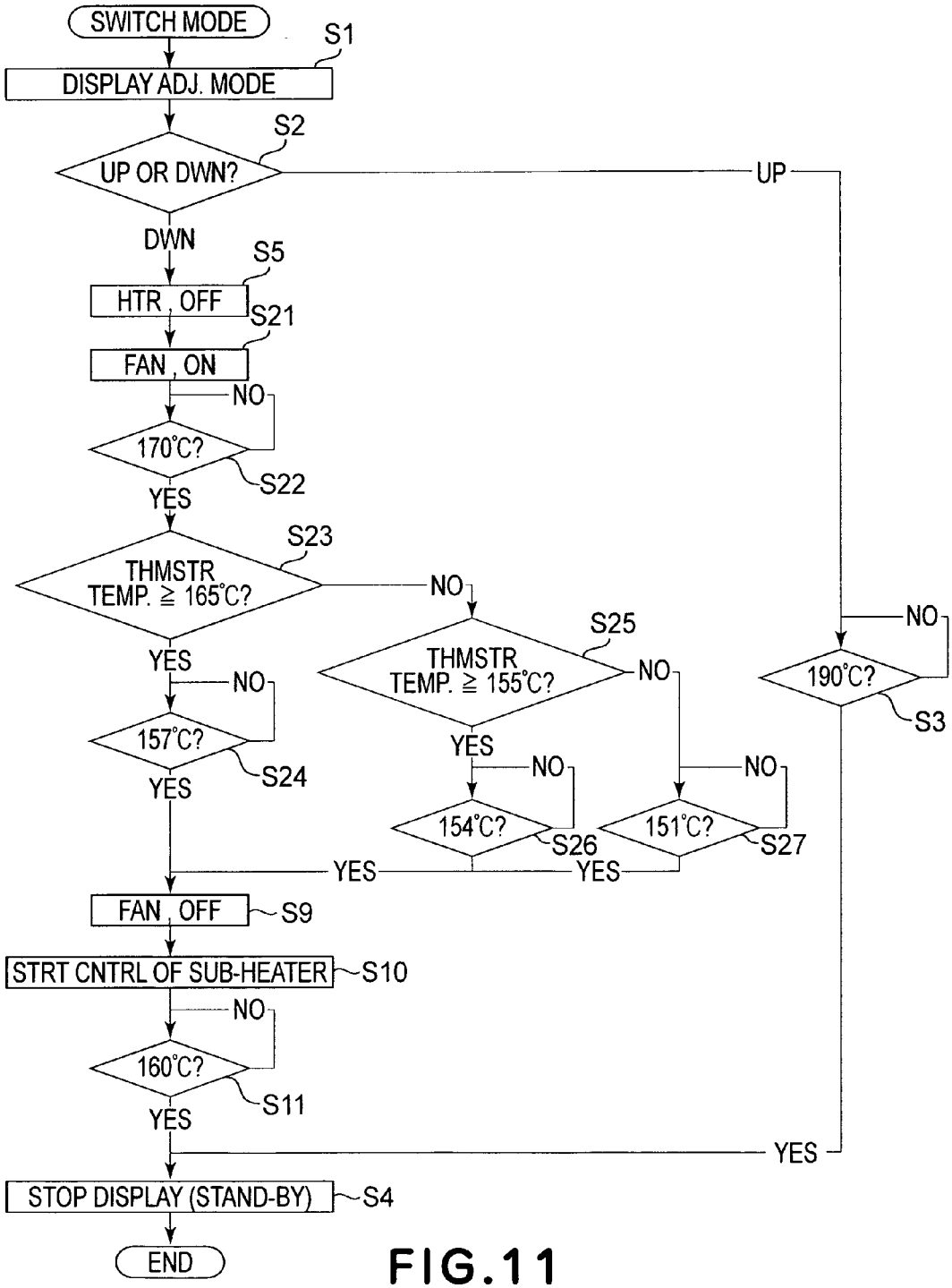
FIG. 11 is a flowchart of the temperature control of the fixation roller in the second preferred embodiment of the present invention.

FIG. 10 is a graph showing the temperature change of the fixation roller, which occurred when the fixing apparatus in this preferred embodiment of the present invention was switched in target temperature immediately after the completion of an image forming operation in which multiple copies of size A4R were continuously produced. FIG. 11 is a flowchart of the control sequence, in this preferred embodiment, carried out to change the fixation temperature of the fixing apparatus. In this embodiment, the preparatory temperature is not set to 155° C. Instead, the preparatory temperature as transitory temperature is adjusted based on the temperature of the fixation roller detected by the subordinate thermistor immediately before the temperature of the fixation roller reaches the lower target temperature.

Therefore, even when the operational mode is switched while the temperature of the end portions of the fixation roller is substantially higher than the temperature of the center portion of the fixation roller, such as immediately after the completion of an image forming operation in which a substantial number of small sheets of recording medium are continuously conveyed through a fixing apparatus, the temperature of the end portions of the fixation roller after the cooling of the fixation roller is higher than that in the first preferred embodiment. Therefore, it is possible to set the preparatory temperature to a higher value than that in the first preferred embodiment. Therefore, it is possible to further reduce the total length of time necessary to complete the process of switching the target temperature of the fixation roller.

Referring to FIG. 10, immediately before the target temperature of the fixation roller is switched, small prints were continuously produced. Therefore, the temperature of the end portions of the fixation roller had risen to 205° C. If the target temperature is changed in this condition, the temperature of the end portions of the fixation roller when the temperature of the fixation roller reach close to 160° C., or the target temperature, after the changing of the target temperature, is higher than that in the first preferred embodiment.

Therefore, when the temperature level detected by the main thermistor became 170° C., the preparatory temperature was adjusted based on the temperature level detected by the subordinate thermistor. More specifically, when the temperature of the fixation roller detected by the main thermistor was 170° C., the temperature of the fixation roller detected by the subordinate thermistor was 160° C., and the preparatory temperature was set to 157° C. Thereafter, the same control sequence as that in the first preferred embodiment was carried out. The total length of time necessary to satisfy the requirements for satisfactory image fixation after the changing of the target temperature was roughly one minute and 30 seconds. In other words, this preferred embodiment also made it possible to accomplish both the object of quickly complete the process of changing the target temperature and the object of rendering the temperature distribution (in terms of lengthwise direction of fixation roller) of the fixation roller, satisfactory for image fixation.

Next, referring to FIG. 11, the control sequence in this preferred embodiment will be described. The control steps similar to those in the first preferred embodiment will be given the same referential symbols as those given for the description of the first preferred embodiment, and will not be described.

Steps S1-S5 carried out after the switching of the operational mode are the same as those in the first preferred embodiment.

In this preferred embodiment, after the heater is turned off (S5), the cooling fans are turned on (S21). Then, it is determined whether or not the temperature of the fixation roller has reached 170° C. (S22). If the temperature of the fixation roller had reached 170° C., it is determined whether or not the temperature of the fixation roller detected by the subordinate thermistor is no less than 165° C. (S23). If the temperature of the fixation roller detected by the subordinate thermistor is no less than 165° C., it is determined whether or not the temperature of the fixation roller has reached 157° C. (S24). If it had reached, the cooling fans are turned off (S9). The control sequence after step S9 is the same as that in the first preferred embodiment.

If it is determined in step S23 that the temperature of the fixation roller detected by the subordinate thermistor is no more than 165° C., it is determined whether or not the temperature of the fixation roller detected by the subordinate thermistor is no less than 155° C. (S25). If it is determined in step S3 that the temperature of the fixation roller detected by the subordinate thermistor is no less than 155° C., it is determined whether or not the temperature of the fixation roller has reached the 154° C., or the preparatory temperature (S26). If it had reached 154° C., step S9 is taken.

If it is determined in step S25 that the temperature of the fixation roller detected by the subordinate thermistor was no more than 155° C., it is determined whether or not the temperature of the fixation roller reached 151° C., or the preparatory temperature (S27). If it is determined in step S9 that the temperature of the fixation roller reached 151° C., step S9 is taken.

Incidentally, in the preferred embodiments of the present invention described above, the cooling apparatus was disposed in the adjacencies of the fixation roller, and the cooling air was directly blown against the fixation roller. However, the fixing apparatus may be structured as follows: the cooling apparatus is disposed in the adjacencies of the pressure roller to cool the pressure roller so that the fixation roller, which rotates in contact with the pressure roller, is cooled by the pressure roller.

Further, in the preferred embodiments described above, the example of an image heating member was the fixation roller. However, an image heating member may be in the form of an endless belt.

Also in the preferred embodiments described above, the example of an image heating apparatus was the fixing apparatus. However, the present invention is also applicable to the following apparatuses: an apparatus for temporarily fix a toner image to recording medium, and an apparatus for improving a toner image in glossiness by reheating the toner image after the toner image has already been temporarily fixed to recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 266008/2005 filed Sep. 13, 2005 which is hereby incorporated by reference.

What is claimed is:

1. An image heating apparatus comprising:

a rotatable image heating member for heating, in a nip, an image on a recording material;

a heater for heating said image heating member;

a cooling device for cooling said image heating member;

wherein said apparatus is operable in a first mode in which the image on the recording material is heated with a first fixing temperature to which said image heating member is set, wherein said apparatus is operable in a second mode, in which the image on the recording material is heated with a second fixing temperature to which said image heating member is set, the second fixing temperature being lower than the first fixing temperature, and a controller for controlling said apparatus such that in an operation of switching from the first mode to the second mode, a temperature of said image heating member lowers from the first fixing temperature to a predetermined temperature that is lower than the second fixing temperature, and then the temperature of said image heating member becomes the second fixing temperature.

2. An apparatus according to claim 1, wherein an image heating operation is prohibited during a period of the operation of switching from the first mode to the second mode.

3. An apparatus according to claim 1, wherein said heater has a heating power which is higher in opposite end portions of said image heating member than in a central portion, with respect to a widthwise direction thereof, wherein said apparatus further comprises a sensor for sensing a temperature of said image heating member, and wherein said controller controls electric power supply to said heater on the basis of an output of said sensor.

4. An apparatus according to claim 3, wherein said sensor is disposed at a position for sensing a temperature of the central portion of said image heating member.

5. An apparatus according to claim 3, wherein the predetermined temperature is variable.

6. An apparatus according to claim 3, further comprising an additional heater, said additional heater having a heating power which is higher in the central portion of said image heating member than in the opposite end portions, with respect to the widthwise direction thereof.

* * * * *